US006425700B1

(12) United States Patent
Silverbrook et al.

(10) Patent No.: US 6,425,700 B1
(45) Date of Patent: Jul. 30, 2002

(54) SEPARATING DEVICE FOR A PRINT ENGINE

(75) Inventors: Kia Silverbrook, Balmain; Tobin Allen King, Cremorne; Garry Raymond Jackson, Haberfield, all of (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/607,250

(22) Filed: Jun. 30, 2000

(51) Int. Cl.[7] ..... B41J 11/70

(52) U.S. Cl. ..... 400/621; 83/485; 83/614; 400/613

(58) Field of Search ..... 400/621, 613; 83/614, 582, 485

(56) References Cited

U.S. PATENT DOCUMENTS 4,507,001 A * 3/1985 Babler ..... 400/144.2
5,312,058 A * 5/1994 Brandt et al. ..... 83/614
6,125,732 A * 10/2000 Haug ..... 83/485

FOREIGN PATENT DOCUMENTS

| | | | |
|---|---|---|---|
| JP | 62-201276 | * | 9/1987 |
| JP | 2-220869 | * | 9/1990 |
| JP | 8-243976 | * | 9/1996 |

* cited by examiner

*Primary Examiner*—Daniel J. Colilla

(57) ABSTRACT

A separating device for a print engine separates a piece of print media from a supply of print media after printing of an image by a printhead of the print engine on said piece of print media. The separating device includes a cutter wheel which acts on the print media to part the piece from the remainder of the supply of print media. The cutter wheel is carried on a carrier. The carrier, in turn traverses a worm gear to be displaced relative to the printhead. An arm of a resiliently flexible material mounts the cutter wheel to the carrier. The arm is configured to facilitate resiliently bending out of the path of the print media of the separating means if the print media is forced prior to completion of a separating operation to inhibit damage being caused to the separating means.

8 Claims, 9 Drawing Sheets

SEPARATING DEVICE FOR A PRINT ENGINE

FIELD OF THE INVENTION

This invention relates to a printer. The invention has particular application in an instantaneous print, digital camera. More particularly the invention relates to a separating device for the printer.

BACKGROUND TO THE INVENTION

The print engine of the present invention utilizes a page width printhead for printing an image on print media passing the printhead.

The term "page width" means that the printhead prints one line at a time on the print media without traversing the print media, or rastering as the print media moves past the printhead.

The print media is supplied to the printhead from a roll of the print media. Accordingly, once an image has been printed on the print media it is necessary to separate that piece, containing the image, from the remainder of the roll.

While the camera with which the print engine is used may alert a user not to pull the print media before the piece containing the image has been separated, a problem could arise if this warning were ignored.

SUMMARY OF THE INVENTION

According to the invention, there is provided a separating device for a print engine, the separating device separating a piece of print media from a supply of print media after printing of an image by a printhead of the print engine on said piece of print media, the separating device including

- a separating means which acts on the print media to part said piece from the remainder of the supply of print media;
- a carrier on which the separating means is carried;
- a displacement means which acts on the carrier to displace the carrier; and
- an arm of resiliently flexible material which mounts the separating means to the carrier, the arm being configured to facilitate resilient bending out of the path of the print media of the separating means if the print media is forced prior to completion of a separating operation to inhibit damage being caused to the separating means.

The separating means may be a cutter wheel rotatably mounted proximate a first end of the arm, the cutter wheel abutting against a bearing surface of a housing of a printhead assembly of a print engine to cut the print media in use to separate said piece from the supply of print media.

The printhead may be a page width printhead and the cutter wheel may be displaceable in a direction parallel to a longitudinal axis of the printhead.

The carrier may be a mounting block to which an opposed end of the arm is attached. The mounting block may be of machined metal, or a synthetic plastics material and said opposed end of the arm may be attached to the mounting block by heat stakes which are melted to retain the opposed end of the arm in position.

The mounting block may be mounted on the displacement means to traverse a width of the print media.

The displacement means may comprise a worm gear on which the mounting block is mounted, the worm gear being mounted in a chassis of the print engine, said chassis inhibiting rotation of the mounting block relative to the worm gear.

The arm may be of spring steel.

BRIEF DESCRIPTION OF THE DRAWINGS

The invention will now be described by way of example with reference to the accompanying diagrammatic drawings in which.

DETAILED DESCRIPTION OF THE DRAWINGS

Figure 1:
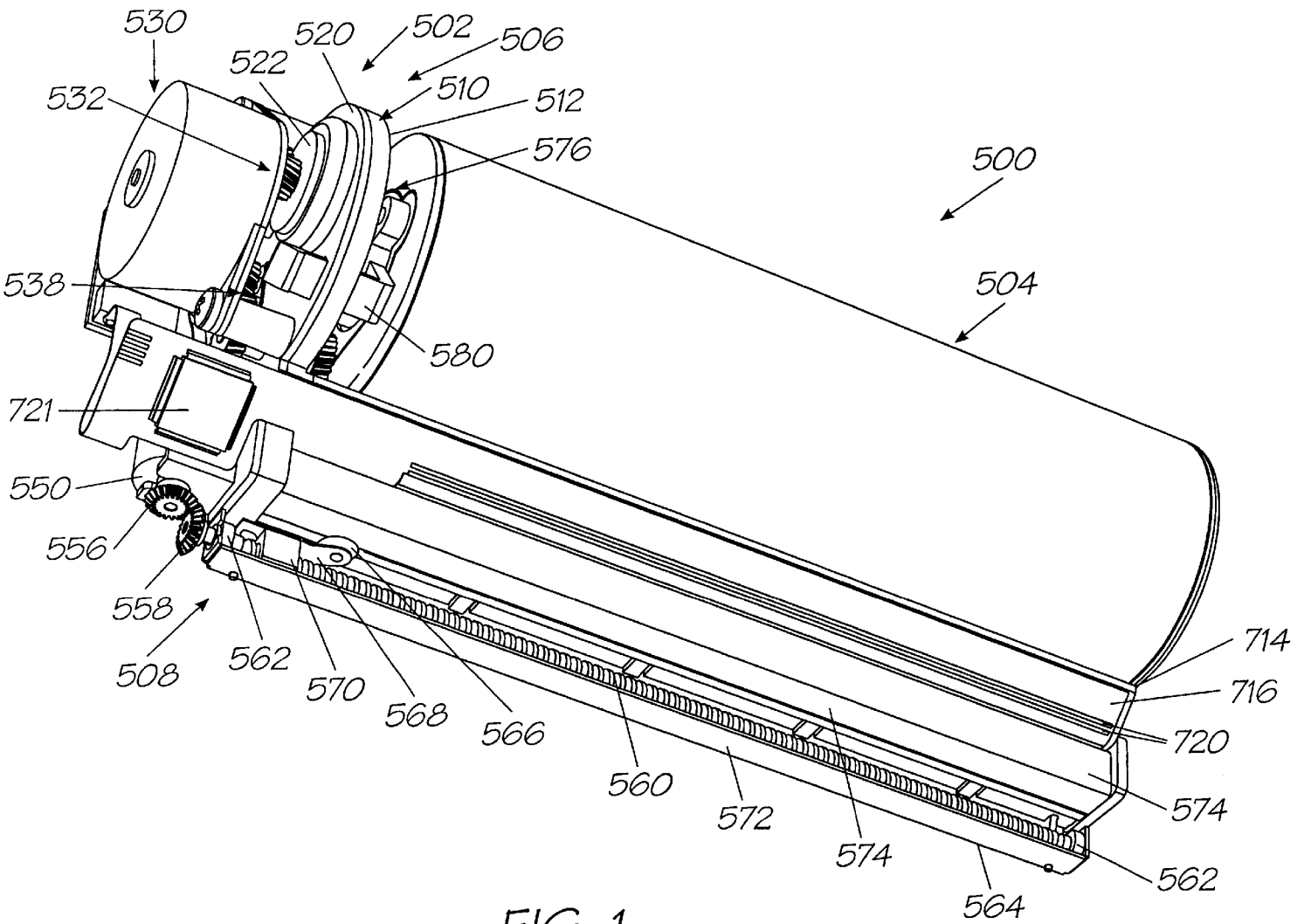
FIG. 1 shows a three dimensional view of a print engine, including components in accordance with the invention.

In the drawings, reference numeral 500 generally designates a print engine, in accordance with the invention. The print engine 500 includes a print engine assembly 502 on which a print roll cartridge 504 is removably mountable.

The print cartridge 504 is described in greater detail in our co-pending applications entitled "A Print Cartridge" (docket number CA02US) and "An Ink Cartridge" (docket number CA04US) filed simultaneously herewith as U.S. Ser. No. 09/607,993 and 09/607,251 respectively, the contents of that disclosure being specifically incorporated herein by reference.

The print engine assembly 502 comprises a first sub-assembly 506 and a second, printhead sub-assembly 508.

Figure 5:
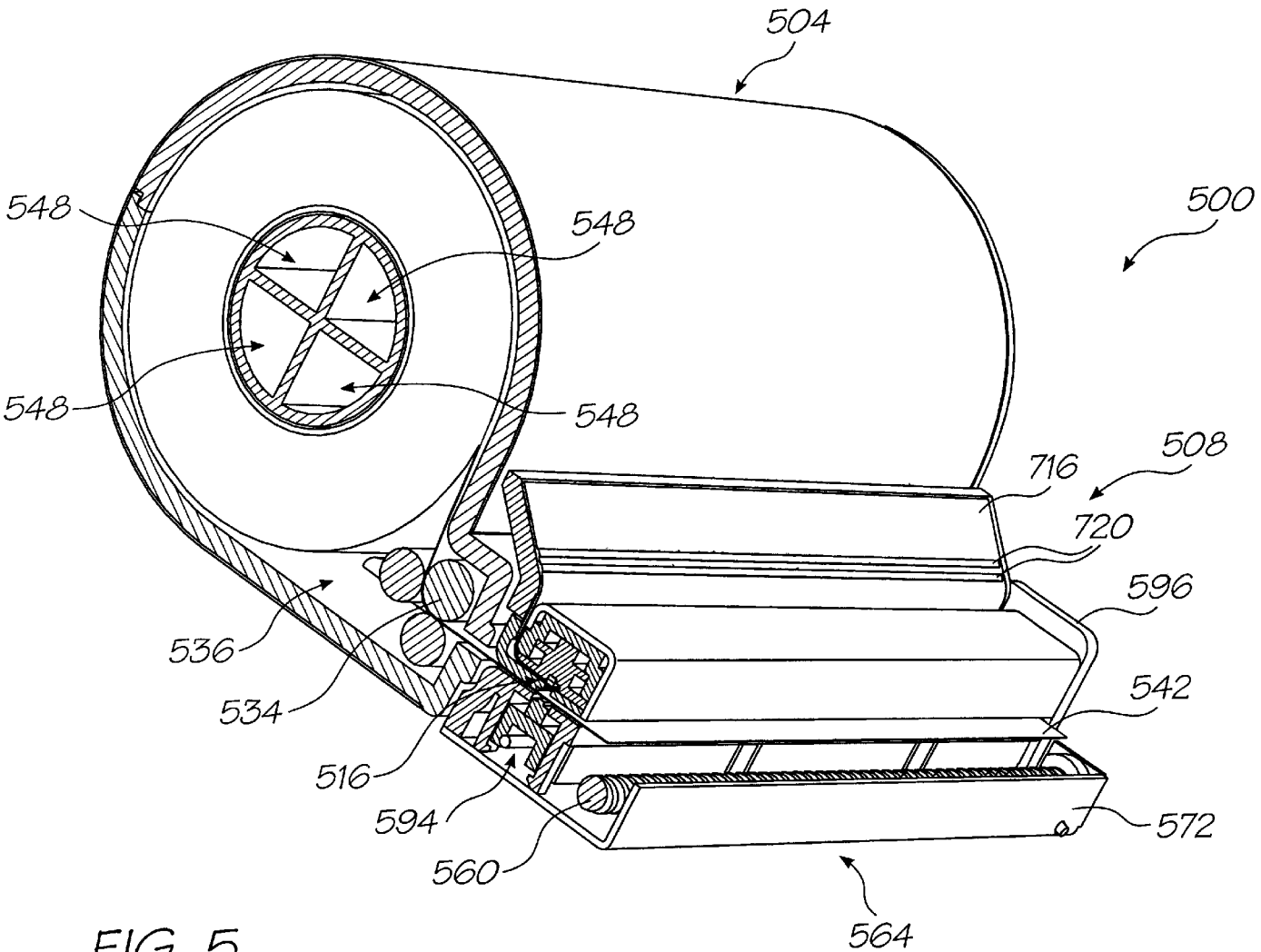
FIG. 5 shows a three dimensional, sectional view of the print engine.
Figure 6:
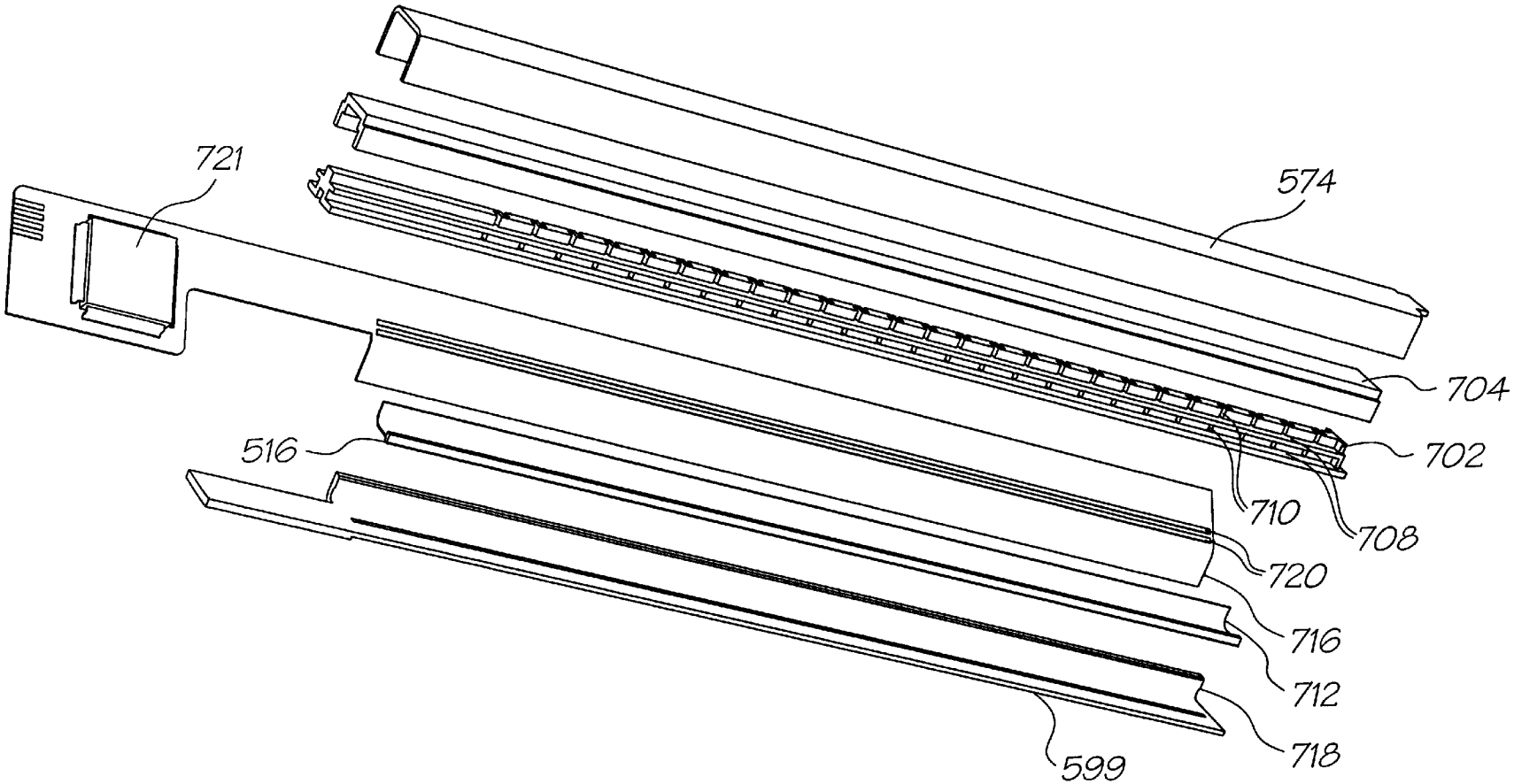
FIG. 6 shows a three dimensional, exploded view of a printhead sub-assembly of the print engine.

The sub-assembly 506 includes a chassis 510. The chassis 510 comprises a first molding 512 in which ink supply channels 514 are molded. The ink supply channels 514 supply inks from the print cartridge 504 to a printhead 516 (FIGS. 5 to 7) of the printhead sub-assembly 508. The printhead 516 prints in four colors or three colors plus ink which is visible in the infrared light spectrum only (hereinafter referred to as 'infrared ink'). Accordingly, four ink supply channels 514 are defined in the molding 512 together with an air supply channel 518. The air supply channel 518 supplies air to the printhead 516 to inhibit the build up of foreign particles on a nozzle guard of the printhead 516.

The chassis 510 further includes a cover molding 520. The cover molding 520 supports a pump 522 thereon. The pump 522 is a suction pump, which draws air through an air filter in the print cartridge 504 via an air inlet pin 524 and an air inlet opening 526. Air is expelled through an outlet opening 528 into the air supply channel 518 of the chassis 510.

Figure 2:
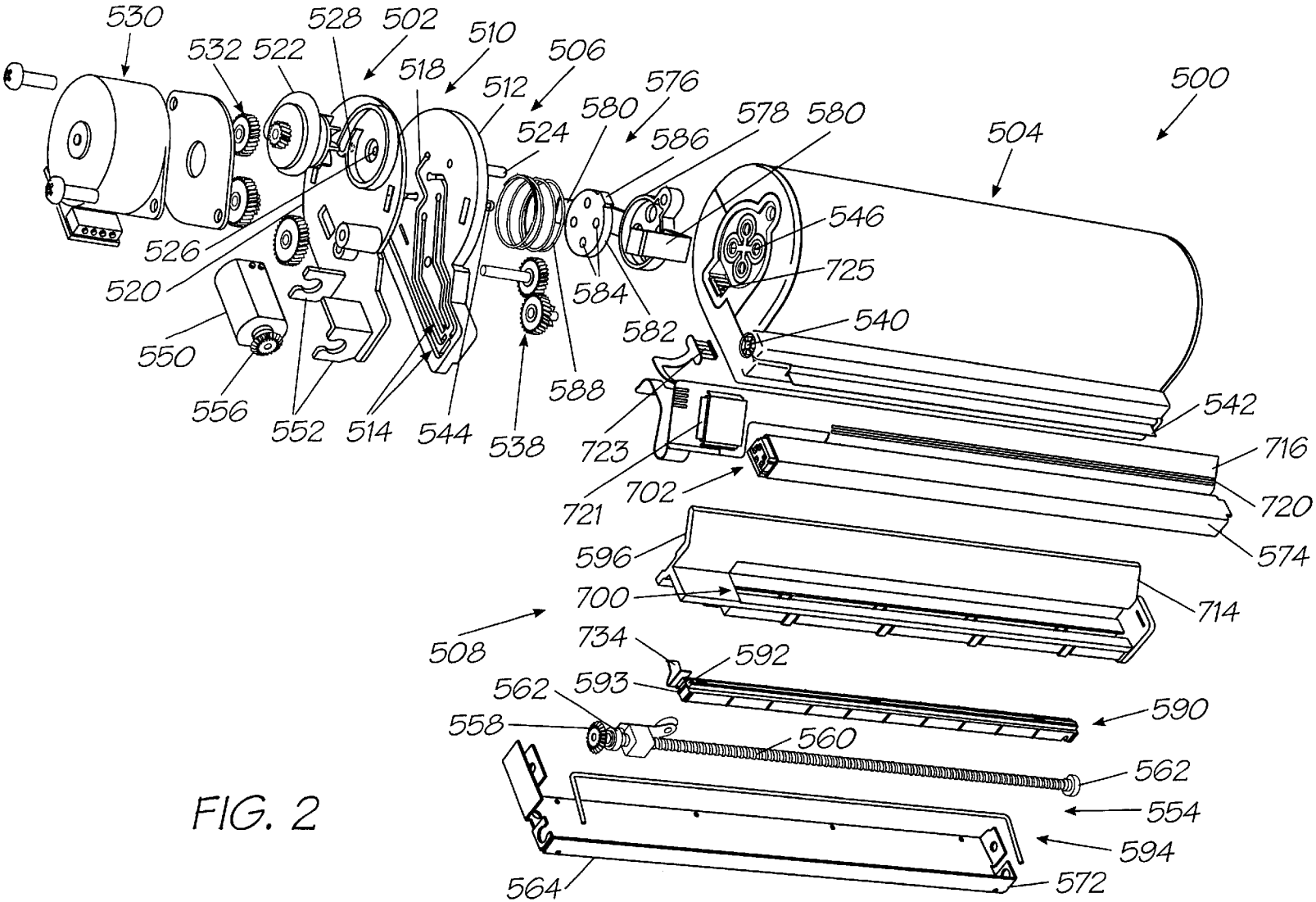
FIG. 2 shows a three dimensional, exploded view of the print engine.

The chassis 510 further supports a first drive motor in the form of a stepper motor 530. The stepper motor 530 drives the pump 522 via a first gear train 532. The stepper motor 530 is also connected to a drive roller 534 (FIG. 5) of a roller assembly 536 of the print cartridge 504 via a second gear train 538. The gear train 538 engages an engagable element 540 (FIG. 2) carried at an end of the drive roller 534. The stepper motor 530 thus controls the feed of print media 542 to the printhead 516 of the sub-assembly 508 to enable an image to be printed on the print media 542 as it passes beneath the printhead 516. It also to be noted that, as the stepper motor 530 is only operated to advance the print media 542, the pump 522 is only operational to blow air over the printhead 516 when printing takes place on the print media 542.

The molding 512 of the chassis 510 also supports a plurality of ink supply conduits in the form of pins 544 which are in communication with the ink supply channels 514. The ink supply pins 544 are received through an elastomeric collar assembly 546 of the print cartridge 504 for drawing ink from ink chambers or reservoirs 548 (FIG. 5) in the print cartridge 504 to be supplied to the printhead 516.

A second motor 550, which is a DC motor, is supported on the cover molding 520 of the chassis 510 via clips 552. The motor 550 is provided to drive a separating means in the form of a cutter arm assembly 554 to part a piece of the print media 542, after an image has been printed thereon, from a remainder of the print media. The motor 550 carries a beveled gear 556 on an output shaft thereof. The beveled gear 556 meshes with a beveled gear 558 carried on a worm gear 560 of the cutter assembly 554. The worm gear 560 is rotatably supported via bearings 562 in a chassis base plate 564 of the printhead sub-assembly 508.

The cutter assembly 554 includes a cutter wheel 566, which is supported on a resiliently flexible arm 568 on a mounting block 570. The worm gear 560 passes through the mounting block 570 such that, when the worm gear 560 is rotated, the mounting block 570 and the cutter wheel 566 traverse the chassis base plate 564. The mounting block 570 bears against a lip 572 of the base plate 564 to inhibit rotation of the mounting block 570 relative to the worm gear 560. Further, to effect cutting of the print media 542, the cutter wheel 566 bears against an upper housing or cap portion 574 of the printhead sub-assembly 508. This cap portion 574 is a metal portion. Hence, as the cutter wheel 566 traverses the capped portion 574, a scissors-like cutting action is imparted to the print media to separate that part of the print media 542 on which the image has been printed.

The sub-assembly 506 includes an ejector mechanism 576. The ejector mechanism 576 is carried on the chassis 510 and has a collar 578 having clips 580, which clip and affix the ejector mechanism 576 to the chassis 510. The collar 578 supports an insert 582 of an elastomeric material therein. The elastomeric insert 582 defines a plurality of openings 584. The openings 584 close off inlet openings of the pins 544 to inhibit the ingress of foreign particles into the pins 544 and, in so doing, into the channels 514 and the printhead 516. In addition, the insert 584 defines a land or platform 586 which closes off an inlet opening of the air inlet pin 524 for the same purposes.

Figure 3:
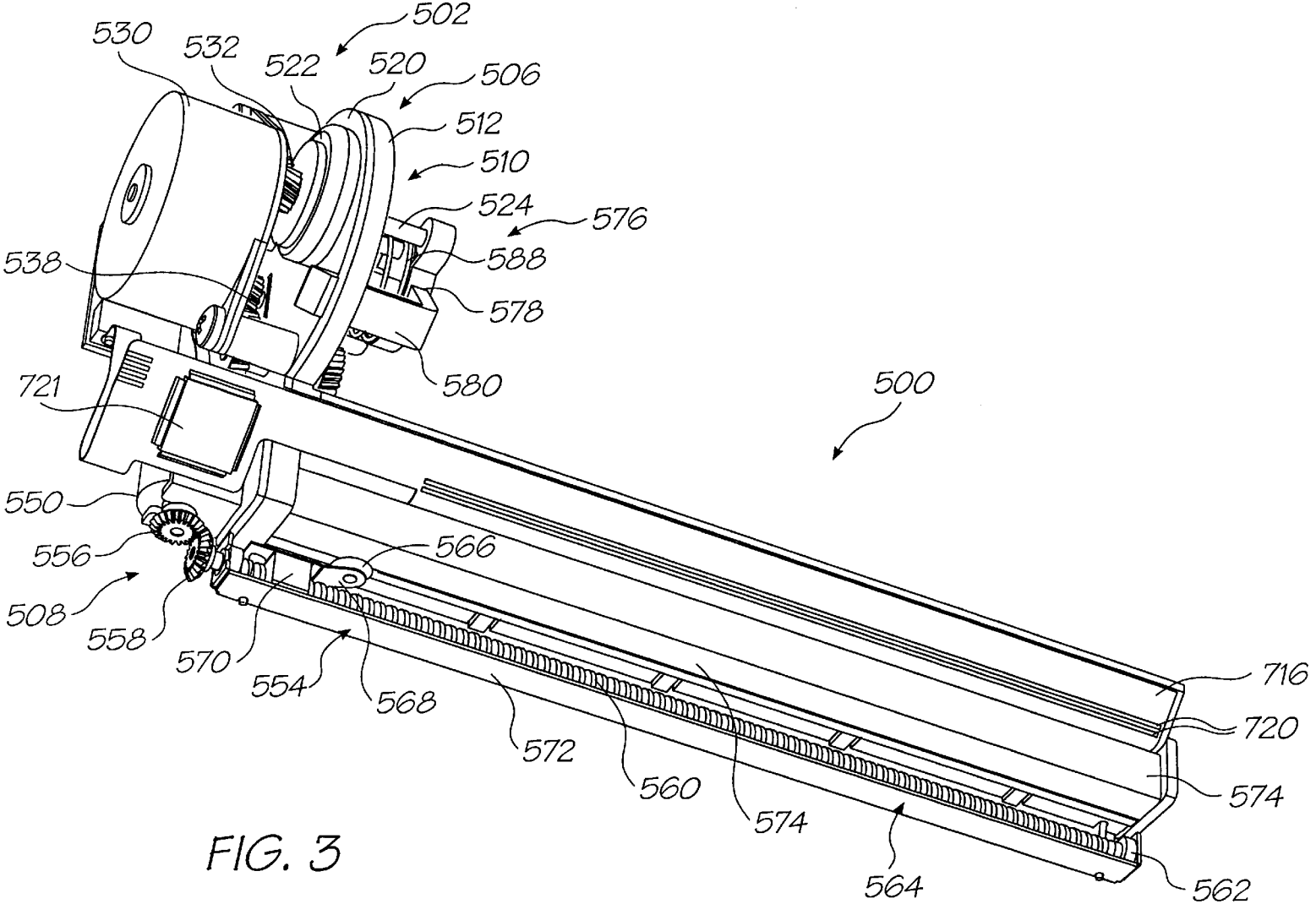
FIG. 3 shows a three dimensional view of the print engine with a removable print cartridge used with the print engine removed.
Figure 4:
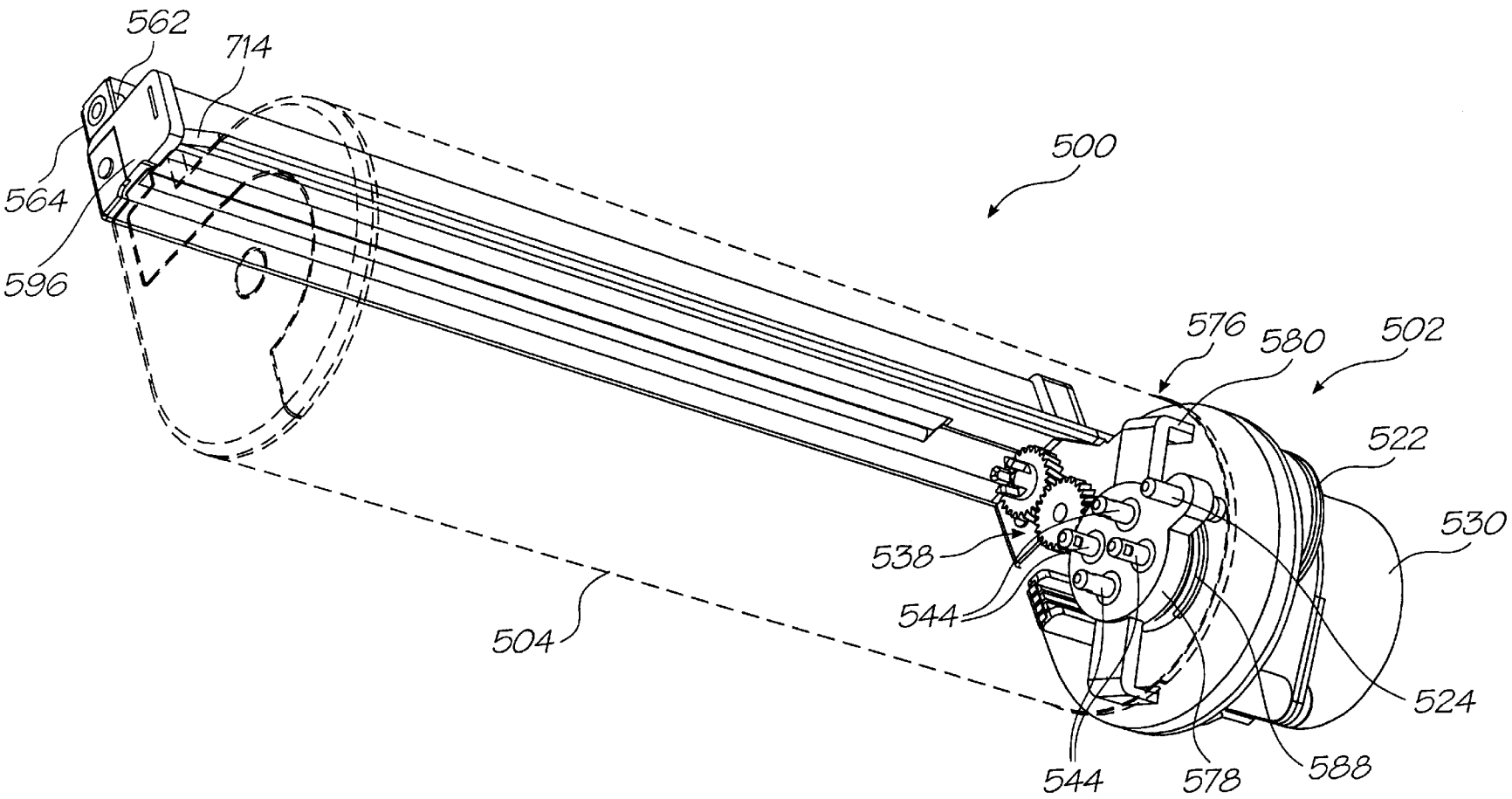
FIG. 4 shows a three dimensional, rear view of the print engine with the print cartridge shown in dotted lines.

A coil spring 588 is arranged between the chassis 510 and the collar 578 to urge the collar 578 to a spaced position relative to the chassis 510 when the cartridge 504 is removed from the print engine 500, as shown in greater detail in FIG. 3 of the drawings. The ejector mechanism 576 is shown in its retracted position in FIG. 4 of the drawings.

The printhead sub-assembly 508 includes, as described above, the base plate 564. A capping mechanism 590 is supported displaceably on the base plate 564 to be displaceable towards and away from the printhead 516. The capping mechanism 590 includes an elongate rib 592 arranged on a carrier 593. The carrier is supported by a displacement mechanism 594, which displaces the rib 592 into abutment with the printhead 516 when the printhead 516 is inoperative. Conversely, when the printhead 516 is operational, the displacement mechanism 594 is operable to retract the rib 592 out of abutment with the printhead 516.

The printhead sub-assembly 508 includes a printhead support molding 596 on which the printhead 516 is mounted. The molding 596, together with an insert 599 arranged in the molding 596, define a passage 598 through which the print media 542 passes when an image is to be printed thereon. A groove 700 is defined in the molding 596 through which the capping mechanism 590 projects when the capping mechanism 590 is in its capping position.

An ink feed arrangement 702 is supported by the insert 599 beneath the cap portion 574. The ink feed arrangement 702 comprises a spine portion 704 and a casing 706 mounted on the spine portion 704. The spine portion 704 and the casing 706, between them, define ink feed galleries 708 which are in communication with the ink supply channels 514 in the chassis 510 for feeding ink via passages 710 (FIG. 7) to the printhead 516.

Figure 8:
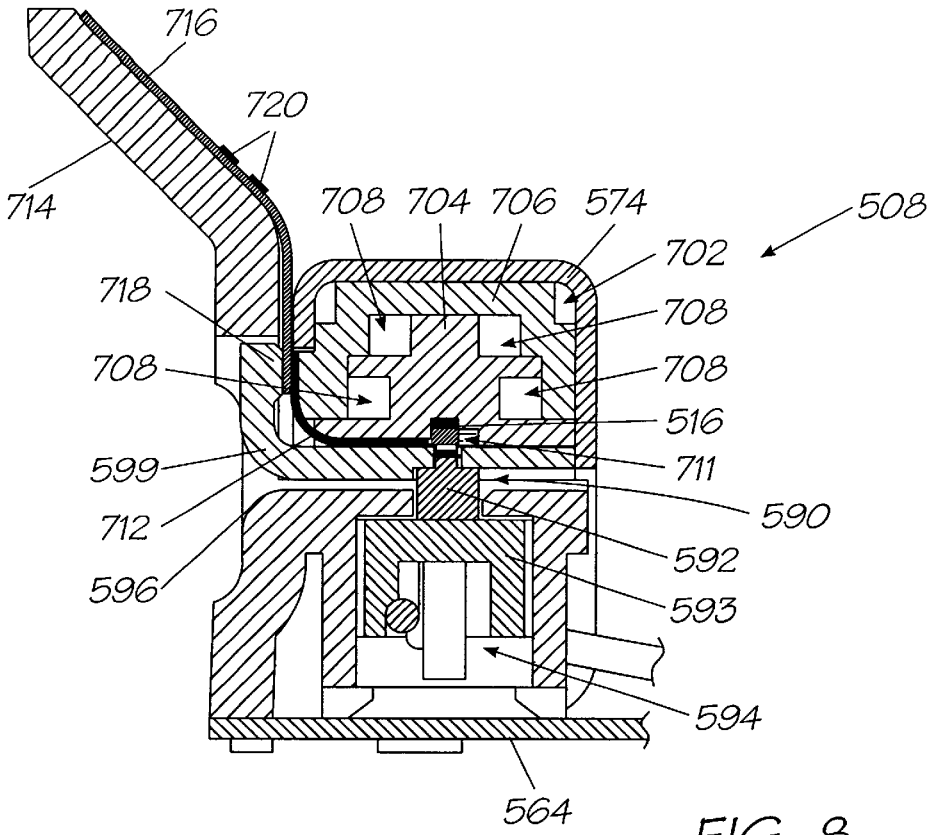
FIG. 8 shows a sectional end view of the printhead sub-assembly with a capping mechanism in a capping position.
Figure 9:
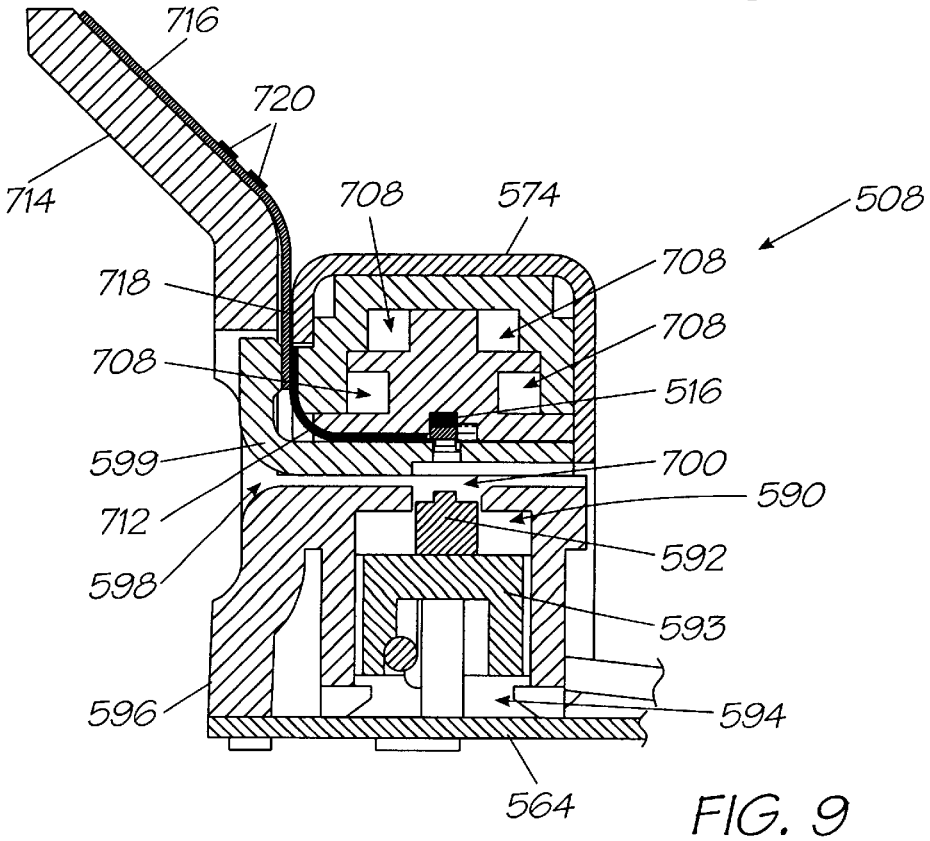
FIG. 9 shows the printhead sub-assembly with the capping mechanism in its uncapped position.

An air supply channel 711 (FIG. 8) is defined in the spine portion 704, alongside the printhead 516.

Electrical signals are provided to the printhead 516 via a TAB film 712 which is held captive between the insert 599 and the ink feed arrangement 702.

The molding 596 includes an angled wing portion 714. A flexible printed circuit board (PCB) 716 is supported on and secured to the wing portion 714. The flex PCB 716 makes electrical contact with the TAB film 712 by being urged into engagement with the TAB film 712 via a rib 718 of the insert 599. The flex PCB 716 supports busbars 720 thereon. The busbars 720 provide power to the printhead 516 and to the other powered components of the print engine 500. Further, a camera print engine control chip 721 is supported on the flex PCB 716 together with a QA chip (not shown) which authenticates that the cartridge 504 is compatible and compliant with the print engine 500. For this purpose, the PCB 716 includes contacts 723 which engage contacts 725 in the print cartridge 504.

Figure 7:
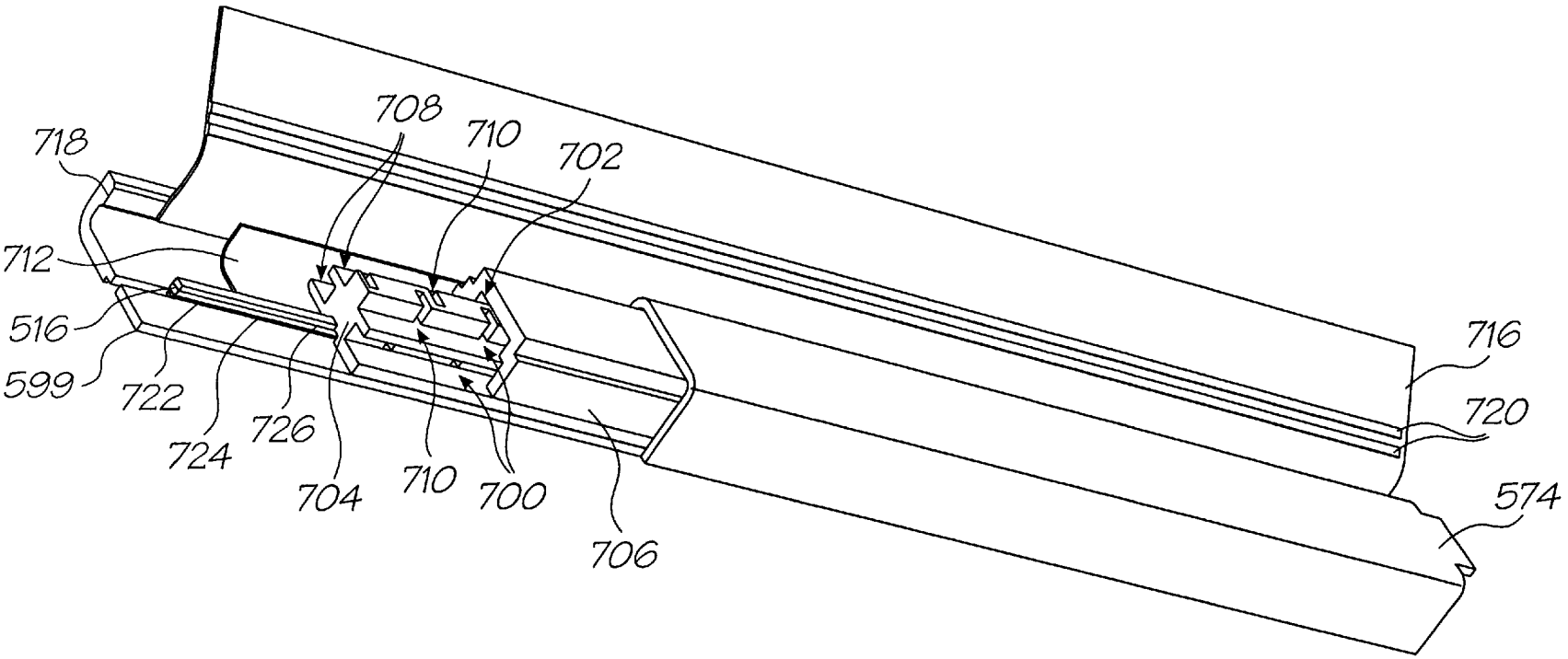
FIG. 7 shows a partly cutaway view of the printhead sub-assembly.

As illustrated more clearly in FIG. 7 of the drawings, the printhead itself includes a nozzle guard 722 arranged on a silicon wafer 724. The ink is supplied to a nozzle array (not shown) of the printhead 516 via an ink supply member 726. The ink supply member 726 communicates with outlets of the passages 710 of the ink feed arrangement 702 for feeding ink to the array of nozzles of the printhead 516, on demand.

Figure 10:
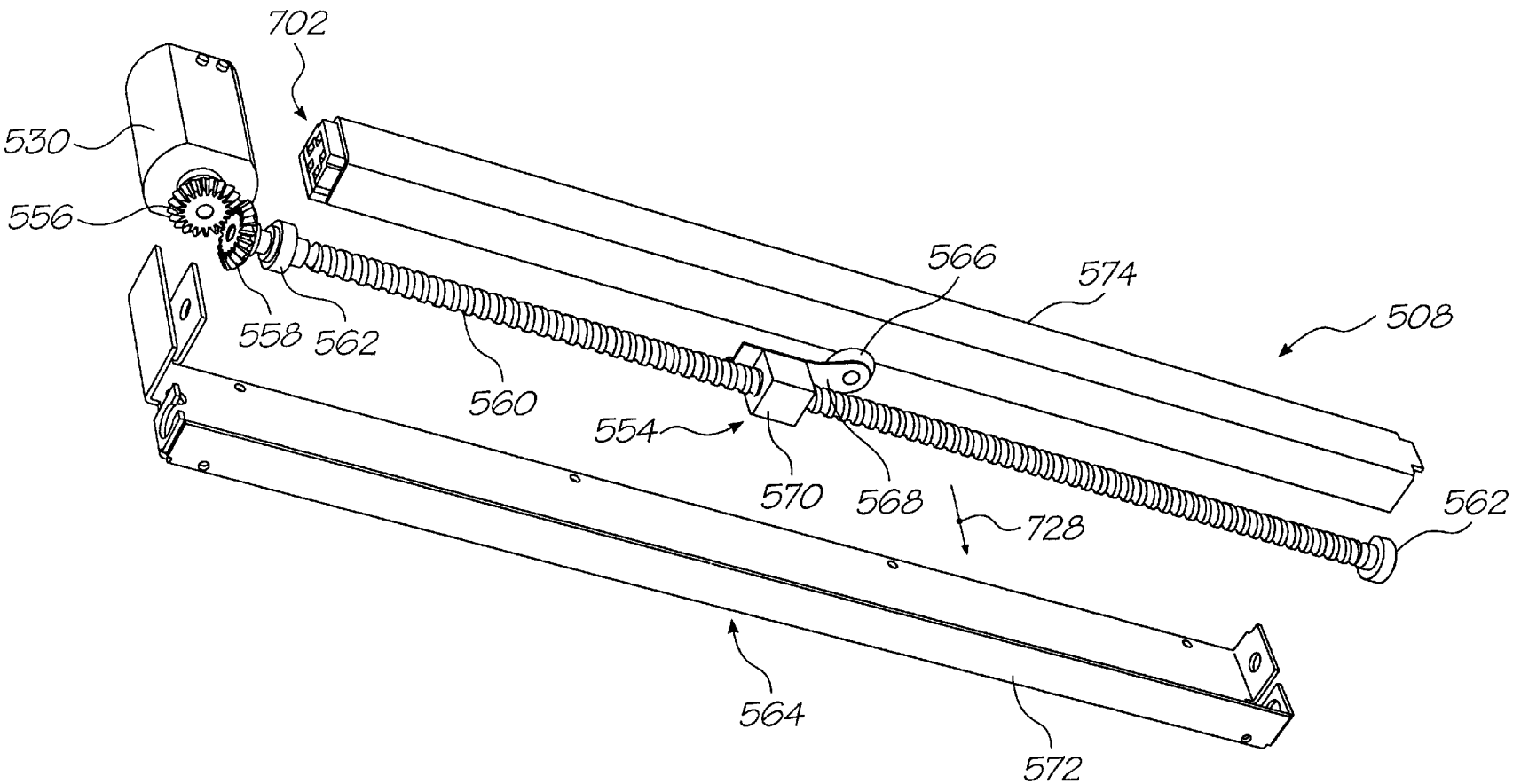
FIG. 10 shows a partially exploded view of part of the printhead sub-assembly of the print engine including a separating device, in accordance with the engine.

Referring to FIG. 10 of the drawings, the cutter assembly 554 is shown in greater detail.

As previously indicated, the cutter assembly 544 includes the cutter wheel 566 which bears against the cap portion 574 of the printhead sub-assembly 508.

The arm 568 by which the cutter wheel 566 is mounted to the mounting block is of spring steel. When the print media 542 is fed past the printhead 516, and printing of an image has been completed, the cutter assembly 544 is displaced to traverse the print media to cut that piece of the print media, containing the image, from the remainder of the print media 542. If a user of the camera in which the print engine 500 is installed should attempt to pull that piece of the print media containing the image from the remainder of the print media prior to complete separation, damage could be caused to the components of the camera and, more particularly, the cutter assembly 554. In other words, should an undue force be exerted in the direction of arrow 728 (FIG. 10) this could cause damage to the cutter assembly 554 and neighboring components.

With the provision of the arm 568, which is of spring steel, the cutter wheel 566 can bend in the direction of the arrow 728, out of the path of the print media. The camera will then reset itself in readiness for the next print operation. If necessary, the image printed on that piece of the print media, which was prematurely pulled by the user, could be reprinted. The displacement of the cutter wheel 566 is monitored by the chip 721.

It is also to be noted that, in order to make the print engine 500 more compact, the size of the print engine assembly 502 is such that most of the components of the assembly 502 are received within a footprint of an end of the print cartridge 504.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A printhead assembly including a printhead and a separating device for separating a piece of print media from a supply of print media after the printhead has printed an image on said piece of print media, the separating device comprising:

a cutter which moves across a print media path and acts on the print media to part said piece from a remainder of the supply of print media;

a carrier on which the cutter is mounted;

a displacement means for displacing the carrier; and an arm of resilient material mounting the cutter to the carrier, the arm being, configured to bend and thereby position said cutter out of said print media path if the print media is forced prior to completion of cutting by said cutter to inhibit damage being caused to the cutter.

2. The assembly of claim 1 including a bearing surface and wherein the cutter is a wheel rotatably mounted proximate a first end of the arm, the wheel acting against said bearing surface in use to separate said piece from the supply of print media.

3. The assembly of claim 2 in which the printhead is a page width printhead and in which the wheel travels in a direction parallel to a longitudinal axis of the printhead.

4. The assembly of claim 3 in which the carrier is a mounting block to which an opposed end of the arm is attached.

5. The assembly of claim 4 in which the mounting block is mounted on the displacement means to traverse a width of the print media.

6. The assembly of claim 5 in which the displacement means comprises a worm gear upon which the mounting block is mounted, the worm gear being mounted in a chassis which inhibits rotation of the mounting block relative to the worm gear.

7. The assembly of claim 1 in which the arm is of spring steel.

8. A printhead assembly including a page width printhead and a separating device for separating a piece of print media from a supply of print media after the printhead has printed an image on said piece of print media, the separating device comprising:

a cutter which moves across a print media path in a direction parallel to a longitudinal axis of the printhead and acts on the print media to part said piece from a remainder of the supply of print media;

a carrier on which the cutter is mounted;

a displacement means for displacing the carrier;

an arm of resilient material mounting the cutter to the carrier, the arm being configured to bend and thereby position said cutter out of said print media path if the print media is forced prior to completion of cutting by said cutter to inhibit damage being caused to the cutter;

a bearing surface; and wherein the cutter is a wheel rotatably mounted proximate a first end of the arm, the wheel acting against said bearing surface in use to separate said piece from the supply of print media, and wherein the carrier is a mounting block to which an opposed end of the arm is attached and the mounting block is mounted on the displacement means to traverse a width of the print media, the displacement means comprising a worm gear upon which the mounting block is mounted, the worm gear being mounted in a chassis which inhibits rotation of the mounting block relative to the worm gear.

* * * * *